US009228790B2

(12) United States Patent
Stephens et al.

(10) Patent No.: US 9,228,790 B2
(45) Date of Patent: Jan. 5, 2016

(54) GUN BARREL AND TUBE CLEANING DEVICE

(75) Inventors: Darin Stephens, Independence, MO (US); John M. French, Eagle, ID (US)

(73) Assignee: Bushnell, Inc., Overland Park, KS (US)

( * ) Notice: Subject to any disclaimer, the term of this patent is extended or adjusted under 35 U.S.C. 154(b) by 1187 days.

(21) Appl. No.: 12/608,711

(22) Filed: Oct. 29, 2009

(65) Prior Publication Data

US 2011/0099880 A1 May 5, 2011

(51) Int. Cl.
*F41A 29/02* (2006.01)

(52) U.S. Cl.
CPC ..... *F41A 29/02* (2013.01)

(58) Field of Classification Search
USPC ..... 42/95
See application file for complete search history.

(56) References Cited

U.S. PATENT DOCUMENTS

| | | | | | |
|---|---|---|---|---|---|
| 363,951 | A * | 5/1887 | Forster | 15/104.16 |
| 621,857 | A * | 3/1899 | Scott | 15/104.165 |
| 1,015,915 | A * | 1/1912 | Strickler | 15/104.18 |
| 1,164,665 | A * | 12/1915 | Reeves | 15/104.16 |
| 2,805,434 | A * | 9/1957 | Hopkins | 15/104.16 |
| 4,503,578 | A * | 3/1985 | McIntyre | 15/104.165 |
| 5,297,310 | A * | 3/1994 | Cox et al. | 15/106 |
| 5,871,589 | A * | 2/1999 | Hedge | 134/8 |
| 5,972,125 | A * | 10/1999 | Hedge | 134/8 |
| 6,088,866 | A * | 7/2000 | Hedge | 15/104.16 |
| 2004/0111948 | A1* | 6/2004 | Schnell | 42/95 |

FOREIGN PATENT DOCUMENTS

| | | |
|---|---|---|
| AU | 723977 | 4/1998 |
| CA | 2264899 | 4/1998 |

* cited by examiner

*Primary Examiner* — Reginald Tillman, Jr.
(74) *Attorney, Agent, or Firm* — Hovey Williams LLP

(57) ABSTRACT

A gun barrel cleaning device comprises a weight, a cord, a boreguide sleeve, a sheath, a brush, a cleaning element, and a lubrication element. The weight provides a mass that helps to insert the device into the barrel of a gun. The weight may be coupled to the high tensile strength cord, which in turn may be coupled to the tubular sheath. The boreguide sleeve may cover the sheath where it is coupled to the cord to smooth the transition from the cord to the sheath. The brush may be connected to the cord and encased by the sheath. The cleaning element, also encased by the sheath, may remove dirt from the gun barrel. The lubrication element, coupled to the sheath, may deposit lubrication in the gun barrel. The gun barrel may be cleaned and lubricated by pulling the device through the barrel.

22 Claims, 2 Drawing Sheets

GUN BARREL AND TUBE CLEANING DEVICE

BACKGROUND OF THE INVENTION

1. Field of the Invention

Figure 1:
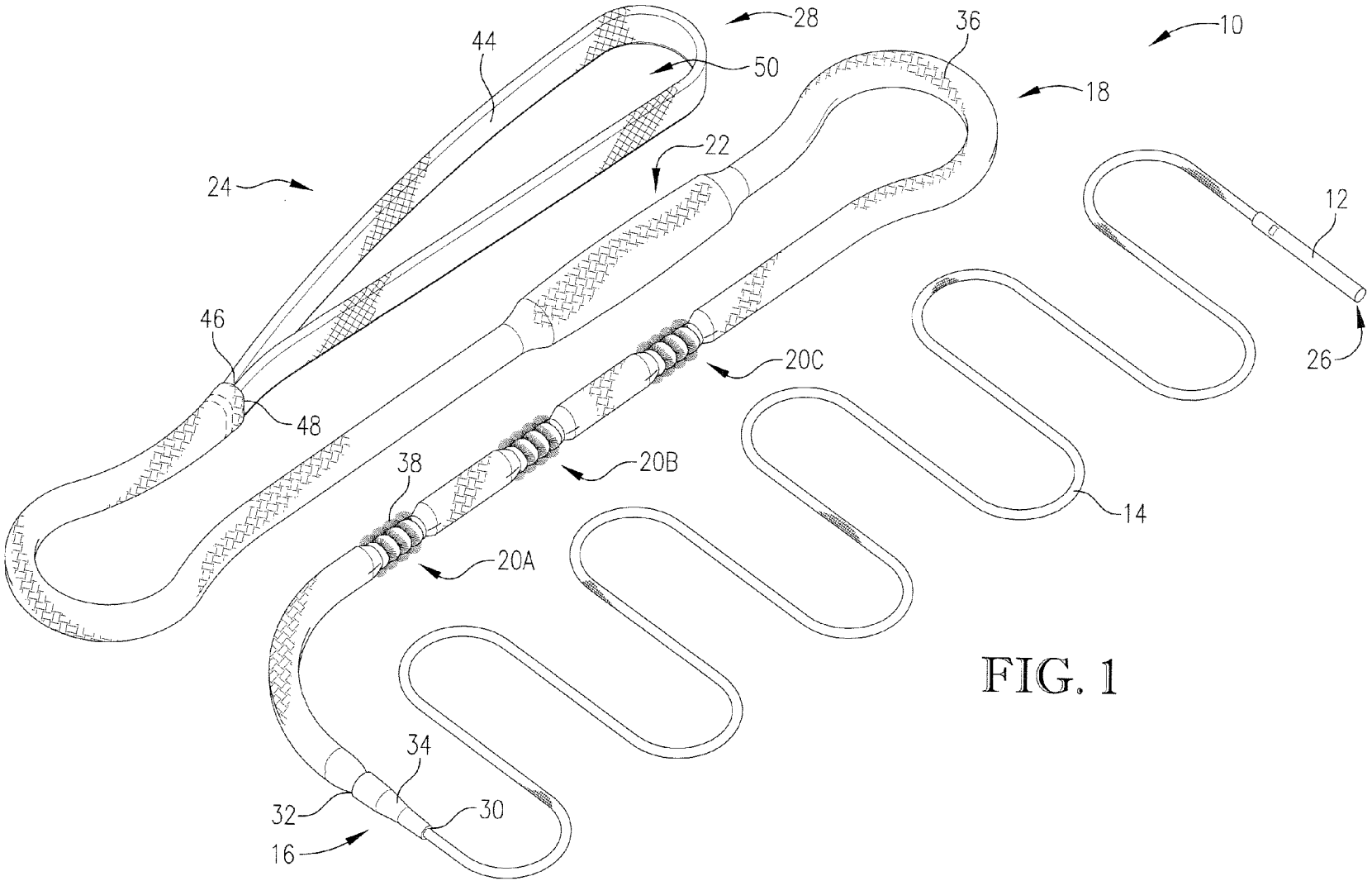

Embodiments of the present invention relate to devices for cleaning and lubricating gun barrels and other tubular devices. More particularly, embodiments of the present invention relate to devices with multiple elements for cleaning and lubricating an inner surface of gun barrels.

2. Description of the Related Art

Devices for cleaning the inside of a gun barrel, or other tubular shaped object, have been developed and generally include a leading end cord coupled to a tubular sheath which encases a brush with bristles that protrude through the sheath. The gun barrel may be cleaned by pulling the cord through the barrel such that the tubular sheath and the brush travel through the barrel. Because the sheath is typically of a larger diameter than the cord and may not enter the barrel smoothly or easily. In addition, the brush may encounter resistance when traveling through the barrel requiring a greater pulling force on the cord, which can cause tearing or ripping of the sheath.

SUMMARY OF THE INVENTION

Embodiments of the present invention solve the above-mentioned problems and provide a distinct advance in the art of cleaning and lubricating gun barrels. More particularly, embodiments of the invention provide a gun barrel cleaning device that cleans and lubricates an inner surface of gun barrels more easily and more reliably.

In one embodiment, the gun barrel cleaning device which broadly comprises a weight, a cord, a boreguide sleeve, a sheath, a brush, a cleaning element, and a lubrication element. The weight provides a mass that helps to insert the device into the barrel of a gun. The weight may be coupled to the cord, which in turn may be coupled to the tubular sheath. The boreguide sleeve may cover the sheath where it is coupled to the cord to smooth the transition from the cord to the sheath and ease the entry of the sheath into the gun barrel. The brush may be encased by the sheath and connected to the cord to minimize ripping of the sheath when extra force is required to pull the brush through the barrel. The cleaning element, also encased by the sheath, may apply solvent to and remove dirt from the gun barrel. The lubrication element, coupled to the opposite end of the sheath from the weight, may deposit lubrication in the gun barrel. The gun barrel may be cleaned and lubricated by pulling the device, from the weight to the lubrication element, through the barrel.

This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

BRIEF DESCRIPTION OF THE DRAWING FIGURES

Figure 2:
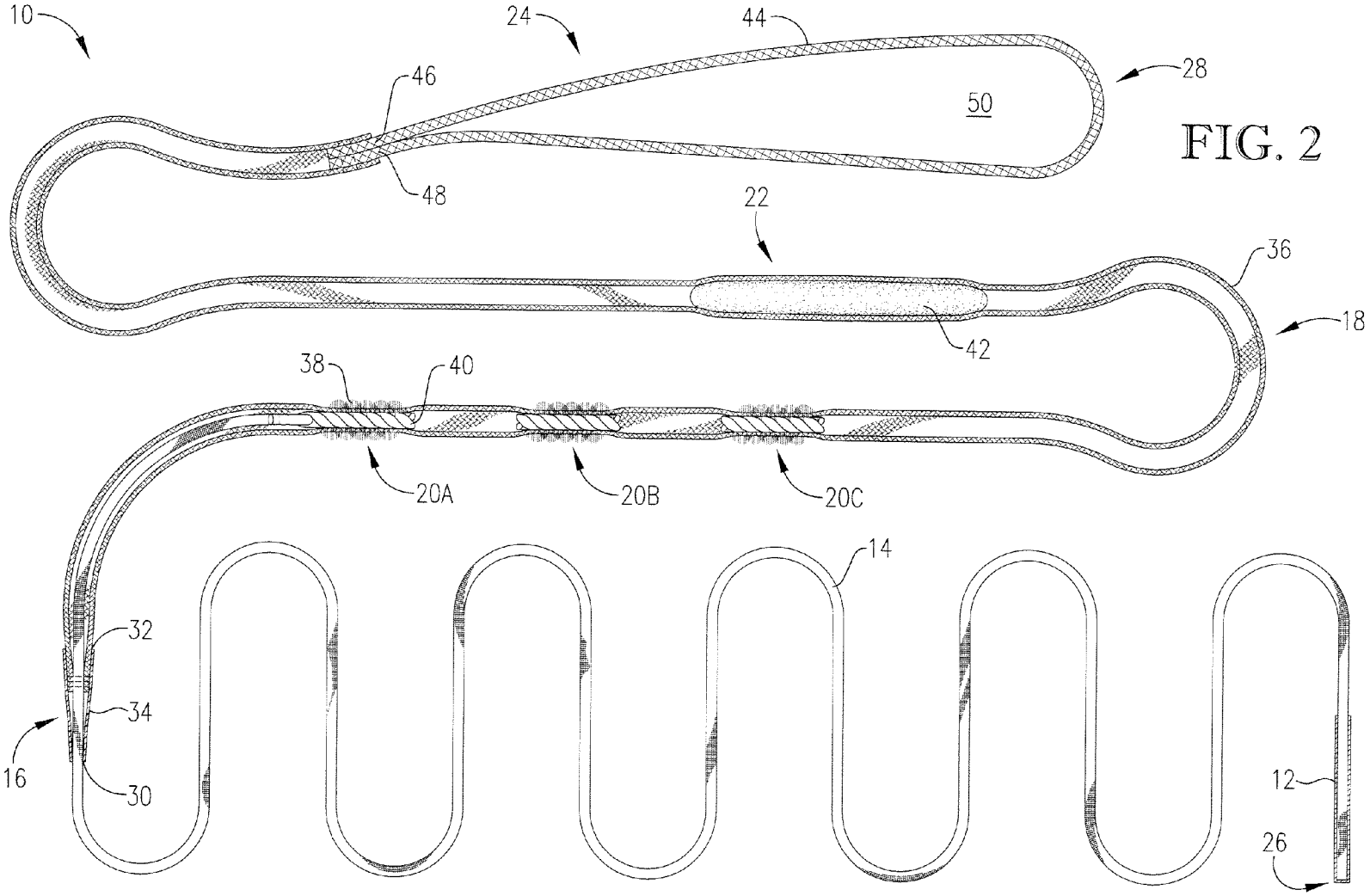

Embodiments of the present invention are described in detail below with reference to the attached drawing figures, wherein:

FIG. 1 is a perspective view of a gun barrel cleaning device constructed in accordance with various embodiments of the present invention; and FIG. 2 is a sectional view of the gun barrel cleaning device cut along a central plane.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

A gun barrel cleaning device 10 for cleaning and lubricating an inner surface of a gun barrel, constructed in accordance with various embodiments of the present invention, is shown in FIGS. 1 and 2. The device 10 offers improvements on the gun barrel cleaning devices of U.S. Pat. Nos. 5,871,589 (the '589 patent), U.S. Pat. No. 5,972,125 (the '125 patent, a continuation of the '589 patent), and U.S. Pat. No. 6,088,866 (the '866 patent, a continuation of the '589 patent), all of which are incorporated by reference herein in their entirety.

The device 10 broadly comprises a weight 12, a cord 14, a boreguide sleeve 16, a sheath 18, a brush 20A, a cleaning element 22, and a lubrication element 24. The terms "leading" and "trailing" may be used throughout this specification, wherein leading generally refers to any portion of the device 10 that, under normal circumstances, enters the gun barrel first or before other portions of the device 10 do. Trailing generally refers to any portion of the device 10 that, under normal circumstances, enters the gun barrel last or after other portions of the device 10 do. For example, the device 10 includes a leading end 26, where the weight 12 is positioned, and a trailing end 28, where the lubrication element 24 is positioned.

The weight 12 generally provides the mass necessary for the cord 14 to fall through the gun barrel when the weight 12 is inserted or dropped into one end of the barrel. Typically, the weight 12 is retrieved at the opposite end of the barrel in order to begin the cleaning process, as discussed in more detail below.

The weight 12 is generally tubular or cylindrical shaped and may be hollow or partially filled, although the trailing end of the weight 12 is usually hollow to accommodate the cord 14, as described below. The leading end of the weight 12 may filled with any appropriate filler or, if hollow, may be crimped and closed. The diameter of the weight 12 is typically smaller than the inner diameter of the smallest gun barrel on which the device 10 may be used. An exemplary diameter of the weight 12 may be approximately 3/16 inches. The weight 12 may be manufactured using high-density material, such as metals. Exemplary materials for the weight 12 may include copper, brass, and the like.

The cord 14 generally provides a component for pulling the device 10 through the gun barrel. The cord 14 may be manufactured from flexible material that has a high tensile strength. Exemplary materials for the cord 14 may include parachute cord or the like. Similar to the weight 12, the diameter of the cord 14 is typically smaller than the inner diameter of the smallest gun barrel on which the device 10 may be used. An exemplary diameter of the cord 14 may be approximately 3/16 inches. The length of the cord 14 may be at least as long as the longest gun barrel on which the device 10 is used.

The leading end of the cord 14 may be coupled to the trailing end of the weight 12. The tip of the cord 14 may be coated with an epoxy or adhesive and inserted into the hollow opening of the weight 12. The trailing end of the weight 12 may be crimped to enclose the cord 14 inside. The epoxy may dry, leaving a strong coupling attachment between the weight 12 and the cord 14.

The boreguide sleeve 16 generally provides a smooth transition from the cord 14 to the sheath 18, which is typically of a greater diameter than the cord 14. Thus, the boreguide sleeve 16 may ease the entry of the sheath 18 into the gun barrel. The boreguide sleeve 16 may be hollow and of tapered tubular or frusto-conical shape that includes a roughly circular leading opening 30 and a roughly circular trailing opening 32 with a sleeve wall 34 extending therebetween. The leading opening 30 may have a smaller diameter than the trailing opening 32. The taper of the sleeve wall 34 between the leading opening 30 and the trailing opening 32 may occur toward the center of the boreguide sleeve 16. Although, in some embodiments, the taper from the trailing opening 32 to the leading opening 30 may be generally smooth and linear.

The boreguide sleeve 16 may be manufactured from plastics or other moldable or formable material. In various embodiments, the boreguide sleeve 16 may be premolded or formed and then integrated into the cleaning device 10. In other embodiments, the sleeve 16 may be directly molded or formed onto the cord 14 and the sheath 18. Since the boreguide sleeve 16 smoothes the transition from the cord 14 to the sheath 18, the boreguide sleeve 16 may overlap a portion of both the cord 14 and the sheath 18.

The tubular sheath 18 generally provides an encasement for the brush 20A and the cleaning element 22. The sheath 18 may also provide a medium in which to disperse solvent or other cleaning agents to the inner surface of the gun barrel. The sheath 18 may include an encompassing sheath wall 36 and may be hollow in some areas, but the sheath wall 36 may surround the brush 20A and the cleaning element 22 in other areas. The sheath wall 36 may be manufactured from flexible and resilient material, such as soft nylon rope material, that allows the sheath 18 to expand and contract. The material of the sheath wall 36 may be woven or braided as described in greater detail in the '589 patent. The material of the sheath 18 may further include the properties of retaining solvents that can be dispersed in the gun barrel as well as being able to capture particulate matter and remove it.

The thickness of the sheath wall 36 may be chosen according to the bore of the gun barrel on which the device 10 is used. For smaller caliber gun bores, the thickness of the sheath wall 36 may be approximately 7/16 inches. For larger caliber gun bores, the thickness of the sheath wall 36 may be approximately 5/8 inches.

The leading end of the sheath 18 may be coupled to the trailing end of the cord 14 by stitching or similar methods either within the boreguide sleeve 16 or in close proximity thereto.

The brush 20A generally cleanses and scrubs the inner surface of the gun barrel when the device 10 is pulled through in order to remove dirt and debris. The brush 20A may include a plurality of bristles 38 that protrude outward through the sheath wall 36. In various embodiments, the brush 20A may be formed by inserting the bristles 38 in a pair of parallel wires 40 that are twisted, such that the bristles 38 follow a helical pattern. In other embodiments, the bristles 38 may be attached to a small cylindrical body of wood, plastic, or the like in a helical pattern. The brush 20A may be inserted into the sheath 18 as described in the '589 patent.

The diameter of the brush 20A may depend on the bore of the gun barrel on which the device 10 is used. The brush 20A diameter may vary from 0.234 inches to 0.889 inches as discussed in detail in the '589 patent.

The leading end of the brush 20A may be coupled to the trailing end of the cord 14, whereby the cord 14 extends through the boreguide sleeve 16 and the interior of the sheath 18 to connect to the brush 20A, as seen particularly in FIG. 2. Since the brush 20A applies a scrubbing force to the inner surface of the gun barrel, the brush 20A usually encounters some friction and resistance when being pulled through the barrel. Thus, the high tensile strength of the cord 14 helps the brush 20A to overcome the resistance and to be pulled through the barrel more reliably.

In various embodiments, the gun barrel cleaning device 10 may include more than one brush 20A. In such embodiments, a second brush 20B and a third brush 20C, substantially similar to brush 20A, may be positioned in close proximity to the first brush 20A to provide additional scrubbing of the gun barrel.

The cleaning element 22 generally applies pressure to the inner surface of the gun barrel during the cleaning process to deposit solvent or other cleaners as well as capture and remove debris. The cleaning element 22 may present a portion along the length of the device 10 wherein the sheath 18 possesses a much greater diameter, or a bulge, than in the portions of the device 10 without the cleaning element 22. In some embodiments, the cleaning element 22 may be formed by placing a foam insert 42 within the sheath wall 36 as described in the '589 patent. In other embodiments, the cleaning element 22 may be formed by forcing the sheath wall 36 to fold over upon itself, creating a tube within a tube that possesses a greater diameter than just one layer of the sheath wall 36 that the sheath 18 normally has. The cleaning element 22 is typically positioned closer to the trailing end of the sheath 18 than the brush 20A is.

In various embodiments not shown in the figures, the gun barrel cleaning device 10 may include more than one cleaning element 22. In such embodiments, a second cleaning element 22 may be positioned in close proximity to the first cleaning element 22 and may be of greater diameter than the first cleaning element 22.

The lubrication element 24 generally deposits lubricant, such as a light gun oil, to the inner surface of the gun barrel after the barrel has been cleaned by the cleaning element 22. The lubrication element 24 may be manufactured from braided or woven material that is flexible and resilient. The material of the lubrication element 24 may also be absorbent or may be able to retain lubricants or oils so as to release the lubricants or oils in the gun barrel. In various embodiments, the lubrication element 24 may be of a different color from the sheath 18.

The lubrication element 24 may include an elongated body 44 with a first end 46 and an opposing second end 48 and may be oriented such that the body 44 is folded over upon itself to create a loop 50. Thus, the first end 46 and the second end 48 of the lubrication element 24 may be both coupled, for example by stitching, to the trailing end of the sheath 18.

During the cleaning process, the loop 50 of the lubrication element 24 may be held by the user to pull the device 10 through the gun barrel in a direction opposite that achieved by pulling on the cord 14, if necessary to remove heavy contamination.

In practice, the gun barrel cleaning device 10 may be used to clean and lubricate a gun barrel as follows. The user may apply cleaner or solvent to the cleaning element 22, particularly the leading end, or other sections of the sheath 18 including the bristles 38 of the brush 20A. The user may also apply a light gun oil or other lubricant to the lubrication element 24. The weight 12 may be aligned with and inserted or dropped into the breach of a gun or the barrel end of a gun. Slight pressure on the weight 12 or light shaking of the gun barrel may be required to get the weight to fall or travel the length of the barrel and be retrieved at the other end.

The user may pull on the weight 12 and/or the cord 14 to have the boreguide sleeve 16 enter the barrel. This should ease the passage of the sheath 18 into the barrel. Further pulling on the cord 14 brings the brush 20A into the barrel. The bristles 38 may scrub and loosen debris from the barrel. After the brush 20A, the cleaning element 22 may enter the barrel. Gun cleaning solvent may be squeezed from the cleaning element 22 and deposited on the inner surface of the barrel. Dirt, debris, and particulates may be captured by the sheath wall 36 as the sheath 18 and the cleaning element 22 are pulled along the gun barrel. Finally, the lubrication element 24 may enter the barrel and spread a thin layer of lubricant along the inner surface of the gun barrel.

If it is determined that there is a large amount of dirt and residue in the barrel, before the lubrication element 24 enters the barrel, the user may hold the loop 50 of the lubrication element 24 and pull the brush 20A and the cleaning element 22 in the reverse direction to provide further scrubbing and cleansing action. The user may pull back and forth on the cord 14 and the loop 50 as necessary to clean the gun barrel. Then the lubrication element 24 may be pulled through the barrel to provide lubrication.

It is noted that equivalents may be employed and substitutions made herein without departing from the scope of the invention as recited in the claims. Although the invention has been described with reference to embodiments of a gun barrel cleaner as illustrated in the attached drawing figures, the invention may be used to clean other items that include a tubular shape. Examples of items including a tubular shape may be found in the automotive industry, mechanical systems, heating, air conditioning, and ventilation systems, musical instruments, and the like.

Having thus described various embodiments of the invention, what is claimed as new and desired to be protected by Letters Patent includes the following:

1. A gun barrel cleaning device for cleaning and lubricating an inner surface of a gun barrel, the cleaning device comprising:

a tubular sheath including a leading end, a trailing end, and a wall;

a flexible cord for pulling the cleaning device through the gun barrel, the cord coupled to the leading end of the sheath;

a boreguide sleeve for easing the entry of the sheath into the gun barrel, the sleeve including a leading end coupled to the cord and a trailing end coupled to the sheath; and a lubrication element for depositing a lubricant along the inner surface of the gun barrel, the lubrication element including a first end and a second end and oriented such that the lubrication element is folded upon itself to form an uncovered open loop and the first end and the second end are connected to the trailing end of the sheath, the lubrication element further including a width and a thickness, wherein the width is greater than the thickness so as to aid in the absorption of the lubricant for subsequent depositing along the inner surface of the gun barrel.

2. The device of claim 1, wherein the leading end of the boreguide sleeve includes an opening with a smaller diameter than an opening of the trailing end of the boreguide sleeve.

3. The device of claim 1, further including a brush encased within the wall of the tubular sheath and including a plurality of bristles that protrude through the wall.

4. The device of claim 3, wherein the cord is coupled to the brush to provide additional strength for pulling the brush through the gun barrel.

5. The device of claim 1, further including a cleaning element positioned along the sheath for retaining a solvent and removing dirt and debris from the gun barrel.

6. The device of claim 5, wherein the cleaning element includes a foam insert.

7. The device of claim 1, further including a cylindrical weight coupled to the cord for inserting the device into the gun barrel.

8. A gun barrel cleaning device for cleaning an inner surface of a gun barrel, the cleaning device comprising:

a tubular sheath including a leading end, a trailing end, and a wall;

a brush encased within the sheath, the brush including a plurality of bristles that protrude through the wall of the sheath;

a flexible cord positioned at a leading end of the cleaning device, the cord being connected to the brush; and a lubrication element for depositing a lubricant along the inner surface of the gun barrel, the lubrication element including a first end and a second end and oriented such that the lubrication element is folded upon itself to form an uncovered open loop and the first end and the second end are connected to the trailing end of the sheath.

9. The device of claim 8, further including a boreguide sleeve for easing the entry of the sheath into the gun barrel, the sleeve including a leading end coupled to the cord and a trailing end coupled to the sheath.

10. The device of claim 9, wherein the leading end of the boreguide sleeve includes an opening with a smaller diameter than an opening of the trailing end of the boreguide sleeve.

11. The device of claim 8, further including a cleaning element positioned along the sheath for retaining a solvent and removing dirt and debris from the gun barrel.

12. The device of claim 11, wherein the cleaning element includes a foam insert.

13. The device of claim 8, further including a cylindrical weight coupled to the cord for inserting the device into the gun barrel.

14. A gun barrel cleaning device for cleaning an inner surface of a gun barrel, the cleaning device comprising:

a tubular sheath including a leading end, a trailing end, and a wall;

a flexible cord for pulling the cleaning device through the gun barrel, the cord passing through the leading end of the sheath;

a boreguide sleeve for easing the entry of the sheath into the gun barrel, the sleeve including a leading end coupled to the cord and a trailing end coupled to the sheath;

a brush encased within the sheath and connected to the cord, the brush including a plurality of bristles that protrude through the wall of the sheath;

a cleaning element positioned along the sheath for retaining a solvent and removing dirt and debris from the gun barrel; and a lubrication element for depositing a lubricant along the inner surface of the gun barrel, the lubrication element including a first end and a second end and oriented such that the lubrication element is folded upon itself to form an uncovered open loop and the first end and the second end are connected to the trailing end of the sheath.

15. The device of claim 14, further including a cylindrical weight coupled to the cord for inserting the device into the gun barrel.

16. The device of claim 14, wherein the leading end of the boreguide sleeve includes an opening with a smaller diameter than an opening of the trailing end of the boreguide sleeve.

17. The device of claim 14, wherein the cleaning element includes a foam insert.

18. The device of claim 1, wherein the lubrication element is connected to the trailing end of the sheath with a stitch, wherein the stitch is shielded by the trailing end of the sheath.

19. The device of claim 8, wherein the lubrication element is connected to the trailing end of the sheath with a stitch, wherein the stitch is shielded by the trailing end of the sheath.

20. The device of claim 8, wherein the lubrication element includes a width and a thickness, such that the width is greater than the thickness so as to aid in the absorption of the lubricant for subsequent depositing along the inner surface of the gun barrel.

21. The device of claim 14, wherein the lubrication element is connected to the trailing end of the sheath with a stitch, wherein the stitch is shielded by the trailing end of the sheath.

22. The device of claim 14, wherein the lubrication element includes a width and a thickness, such that the width is greater than the thickness so as to aid in the absorption of the lubricant for subsequent depositing along the inner surface of the gun barrel.

* * * * *